US005940934A

United States Patent [19]

Turner

[11] Patent Number: 5,940,934

[45] Date of Patent: Aug. 24, 1999

[54] SEPARABLE HINGE

[76] Inventor: Glen P. Turner, 6637 Turner La., South Rockwood, Mich. 48179

[21] Appl. No.: 09/016,709

[22] Filed: Feb. 2, 1998

[51] Int. Cl.[6] ..... E05D 7/10

[52] U.S. Cl. ..... 16/257; 16/275

[58] Field of Search ..... 16/257, 259, 262, 16/275

[56] References Cited

U.S. PATENT DOCUMENTS

| | | | |
|---|---|---|---|
| 323,018 | 7/1885 | Atkins | 16/275 |
| 1,003,618 | 9/1911 | Laski | 16/275 |
| 1,217,607 | 2/1917 | Karl | 16/275 |
| 1,414,843 | 5/1922 | Voss | 16/257 |
| 2,010,901 | 8/1935 | Schramm | 16/275 X |
| 4,244,081 | 1/1981 | Beyer et al. | 16/275 X |
| 4,713,861 | 12/1987 | Bancroft | 16/222 |
| 5,033,161 | 7/1991 | Chavez | 16/262 |

FOREIGN PATENT DOCUMENTS

| | | |
|---|---|---|
| 1289267 | 2/1962 | France . |

*Primary Examiner*—Brian K. Green

*Attorney, Agent, or Firm*—Peter D. Keefe

[57] ABSTRACT

A separable hinge composed of two hinge components, each having a leaf and at least one tubular knuckle. The knuckles are interleaved when the two hinge components are assembled. The leaves provide an attachment structure. A first hinge component has at least one first knuckle having a sub-assembly composed of pair of spring-loaded balls resident in a first bore thereof. The ends of the first bore are configured to abuttingly interact with the balls so as to allow the balls to protrude only partly from the first bore even as spring biasing tends to cause the balls to exit the tube. A second hinge component has at least two second knuckles, one located at each end of a first knuckle. The ends of the second knuckles that face a first knuckle are provided with a second bore having a predetermined cross-section which accepts an exactly predetermined portion of the protruding portions of the balls. Consequently, the balls protrude into the second bore of the second hinge components a precise amount which determines, in concert with the biasing spring force on the balls, the magnitude of the shear force which is necessary to cause the first and second hinge components to be separated from each other. Since the ball and biasing spring sub-assembly does not fly apart when the first knuckle separates from the second knuckle, it is a simple matter to reassemble the separable hinge thereafter.

14 Claims, 2 Drawing Sheets

SEPARABLE HINGE

BACKGROUND OF THE INVENTION

1. Field of the Invention

The present invention relates to hinges used for pivoting one article relative to another. More particularly, the present invention relates to a hinge having a spring loaded ball and socket arrangement for providing pivoting of the hinge components and further for providing separation of the hinge components in response to a predetermined level of shear force acting on the hinge.

2. Description of the Prior Art

Hinges are composed of two relatively pivotable components, each of which being connected to a respective article to thereby provide pivoting of one of the articles with respect to the other. A common type of hinge utilizes a pair of leaves with interleaved tubular knuckles and a hinge pin. In this arrangement, the leaves are connected to respective articles, such as by threaded fasteners or rivets, and the knuckles are then interleaved so that the tubes of the knuckles are aligned. The hinge pin is then placed through the knuckles, whereupon the leaves are pivotable on the hinge pin with the weight of any free standing article being supported by the interface between the interleaved knuckles.

While hinges are well known and are very well suited to the purpose for which they are intended, there remains the problem that the hinge pin does not admit separation of the leaves in the event some untoward incident should arise, as for example someone trapped in a locked room or a driver trapped in a burning motorized conveyance.

Accordingly, what is needed in the art is a hinge which admits of being separated upon the application of a predetermined level of shear force, yet provides hinge action in a perfectly able manner.

In the prior art, it is known to provide a hinge using a spring-loaded ball and socket arrangement, as for example disclosed in U.S. Pat. No. 1,217,607, which mentions separability of the hinge being provided thereby, and in the drawings of French Patent 1,289,267. However, in these arrangements the balls are held in position only by being in a fully assembly state. In the event the hinge becomes separated, the balls and spring will fly off randomly, likely becoming lost or possibly causing injury or damage. Further, these hinges are not conventional in appearance and external structural aspects, thereby potentially limiting their serviceability in conventional applications.

Accordingly, there yet remains needed in the art a separable hinge operating on a spring loaded ball and socket arrangement, wherein the spring loaded balls thereof are pre-assembled and remain assembled whether or not the hinge is assembled or separated.

SUMMARY OF THE INVENTION

The present invention is a separable hinge operating on a spring loaded ball and socket arrangement, wherein the spring loaded balls thereof are pre-assembled and remain assembled whether or not the hinge is assembled or separated.

The separable hinge according to the present invention is composed a two hinge components, each having a leaf and at least one tubular knuckle. The knuckles of are relatively staggered such that they interleave when the two hinge components are assembled. The leaves provide an attachment structure for connecting the hinge components to respective articles, such as for example a door and its door frame or a window and its mounting. Where pivoting of one article relative to another involves the hinge carrying the weight of the pivoting article, the weight is supported at the interface between the interleaved knuckles.

A first hinge component has at least one first knuckle having a pair of spring-loaded balls resident in a first bore thereof such that the balls partly protrude at opposed ends of the first bore. The ends of the first bore are configured to abuttingly interact with the balls so as to retain the balls with respect to the first bore even as spring biasing tends to cause the balls to exit the tube. The first bore has a cross-section which admits placement of the balls thereinside with little play therebetween at the circumference of the balls.

A second hinge component has at least two second knuckles, one located at each end of a first knuckle. The ends of the second knuckles that face a first knuckle are provided with a second bore having a predetermined cross-section which accepts an exactly predetermined portion of the protruding portions of the balls. Consequently, the balls protrude into the second bore of the second hinge components a precise amount which determines, in concert with the biasing force on the balls, the magnitude of the shear force which is necessary to cause the first and second hinge components to be separated from each other.

In operation, a first bore is drilled in the first knuckles, wherein the first bore cross-section is conically reduced at a second end of the first knuckle (wherein the drill bit entered at a first end of the first knuckle). Next, a sub-assembly composed of a pair of balls and a biasing spring are placed therein, wherein the conically reduced cross-section at the second end traps the adjoining ball from exiting the first bore. The first end is swedged by a swedging tool which provides a reduced cross-section at the first end which traps the adjoining ball from exiting the first bore. Accordingly, the balls at the opposing first and second ends protrude a predetermined amount external to the first bore, yet are retained with respect to the first bore. Next, the second knuckles are drilled with a predetermined cross-sectioned second bore. The first and second knuckles are then interleaved, whereupon an exactly predetermined portion of the balls enter into respective second bores.

Now the assembled separable hinge is connected to two relatively pivotal articles via the leaves. The separable hinge provides pivoting therebetween in an excellently functional manner. However, if a predetermined magnitude of shear force is applied to the first and second components of the separable hinge, the balls will be forced to retract against the biasing spring into the first bore of the first knuckle, whereupon the first and second knuckles will separate.

Accordingly, it is an object of the present invention to provide a separable hinge which hinge function is very reliable, and separability precisely predictable in response to shear force acting thereupon.

It is an additional object of the present invention to provide a separable hinge wherein the hinge components thereof have pre-assembled sub-assemblies which remain assembled whether or not the hinge is fully assembled.

It is yet another object of the present invention to provide a separable hinge operating on a spring-loaded ball and socket principle, wherein the balls are permanently trapped with respect to a component of the hinge independent of the state of separation of the hinge.

It is still a further object of the present invention to provide a separable hinge operating on a spring-loaded ball and socket principle, wherein the balls are precisely mated with respect to bore cross-sections to thereby provide a hinge having very little play and having separability predicated upon a precisely predetermined shear force being applied thereto.

These, and additional objects, advantages, features and benefits of the present invention will become apparent from the following specification.

DETAILED DESCRIPTION OF THE PREFERRED EMBODIMENT

Figure 1:
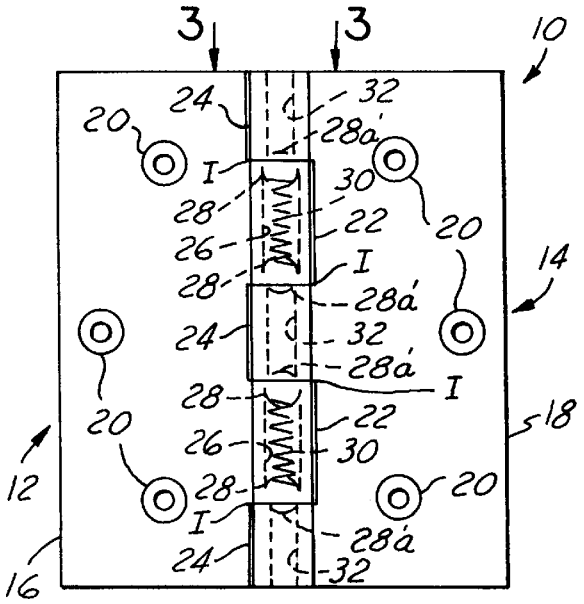
FIG. 1 is a partly sectional plan view of the separable hinge according to the present invention, shown in an assembled state.
Figure 3:
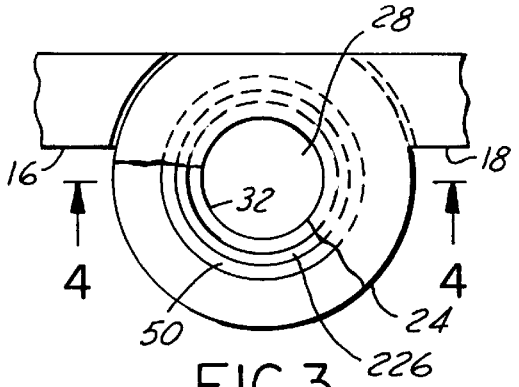
FIG. 3 is a partly sectional end view of the separable hinge, seen along line 3—3 in FIG. 1.

Referring now to the drawing, FIG. 1 generally depicts a preferred embodiment of a separable hinge 10 according to the present invention. The separable hinge 10 includes a first hinge component 12 and a second hinge component 14 which are mutually assembled to form the separable hinge, and which are subject to being separated in the event predetermined minimum magnitude of shear force is applied thereto.

Each hinge component 12, 14 includes, preferably, a respective leaf 16, 18 which is utilized to attach the first and second hinge components to respective articles which are to be hingedly connected to each other via the separable hinge 10. In this regard, the leaves 16, 18 are advantageously provided with holes 20 through which a threaded fastener or other fastener, such as rivets, may pass into the respective article. Otherwise, the leaves 16, 18 may be alternatively connected to a respective article, such as for example by welding.

The first and second hinge components 12, 14 further include tubularly shaped first and second knuckles 22, 24, respectively. The first and second knuckles 22, 24 are arranged so that they mutually interleave when aligned, whereupon the first and second hinge components 12, 14 are in their mutually assembled configuration (as shown at FIG. 1). Each of the first knuckles 22 are provided with a first bore 26 into which is located two balls 28 which are mutually biased away from each other by a biasing spring 30, yet trapped by the respective first knuckle so that only a protruding portion 28*a* thereof protrudes from the first bore (see FIG. 2). Each of the second knuckles 24 has a second bore 32 which accepts a predetermined received portion 28*a*' of the balls 28 when the first and second hinge components 12, 14 are in the assembled configuration. There are preferably two first knuckles 22 and three second knuckles 24, wherein a second knuckle is located at each end of a first knuckle for receiving the protruding ball 28 thereof.

In operation, the first and second hinge components 12, 14 are pivotable at the interface I between adjoining first and second knuckles 22, 24, wherein the balls 28 locate the adjoining first and second knuckles so as to keep them mutually aligned. In the event a predetermined minimum magnitude of shear force acts on the first and second hinge components 12, 14, then the balls 28 will be caused to retract into the first knuckles 24, and the first and second hinge components will thereupon separate from each other.

In order to describe with greater specificity the structure and function of the separable hinge 10, attention will now be directed additionally to FIGS. 2 through 10B.

Figure 4:
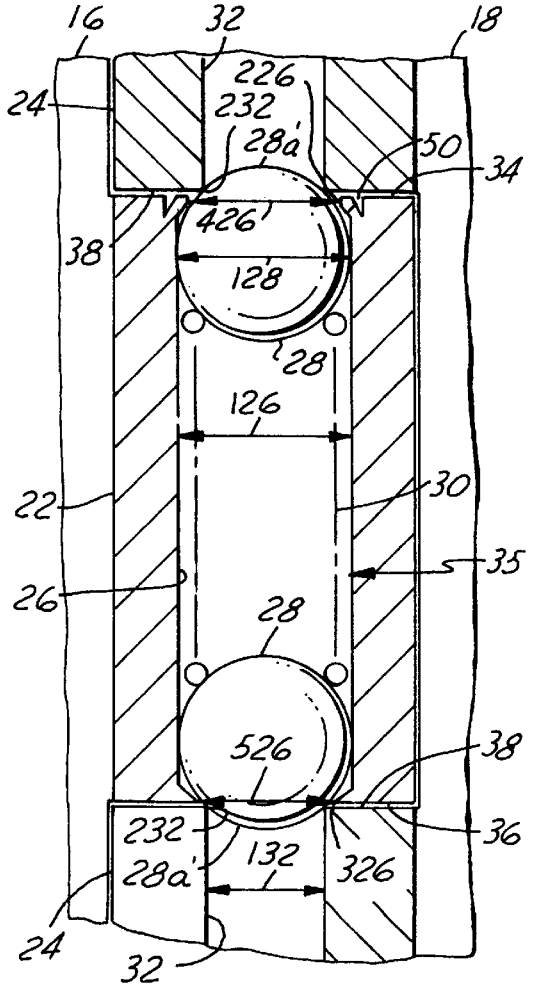
FIG. 4 is a partly sectional side view of the separable hinge, seen along line 4—4 in FIG. 3.
Figure 5:
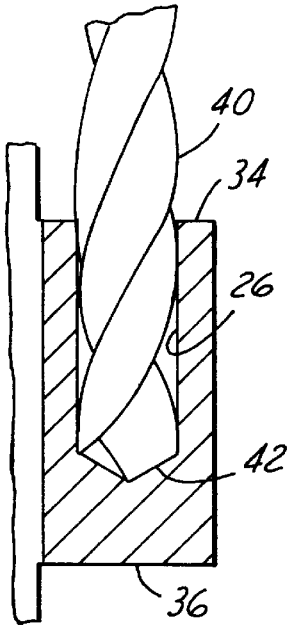
FIGS. 5 and 6 are a partly sectional side view of a first knuckle according to the present invention being provided with a first bore, commencing at a first end thereof and terminating just short of a second end thereof.

As shown best at FIG. 4, a sub-assembly 35 composed of two balls 28 and a biasing spring 30 therebetween is located in the first bore 26 of the first knuckles 22. The balls 28 have a ball diameter 128 which is just less than the first diameter 126 of the first bore 26, whereby there is little or no play therebetween, yet the balls are slidable therealong. The balls 28 are trapped in the first bore 26 via a first annular boss 226 adjacent the first end 34 of the first knuckle and a second annular boss 326 adjacent the second end 36 of the first knuckle. The first and second annular bosses 226, 326 have respective diameters 426, 526 that are reduced in relation to the ball diameter 128 and reduced in relation to the first diameter 126. The first and second annular bosses 226, 326 allow a protruding portion 28*a* of the balls 28 to protrude from the first bore at the first and second ends 34, 36 thereof, as shown at FIG. 2.

As further shown best at FIG. 4, the second bore 32 of the second knuckles 24 has a precisely preselected second diameter 132 which allows for acceptance therein of a predetermined received portion 28*a*' of the balls 28. It will be noted in this regard that the balls 28 rest upon the annular rim 232 of the second bore 32 at an end 38 of the second knuckle 24. Further, it will be noted that the balls 28 are slightly spaced from the respective first or second annular bosses. It is to be noted that the second bore 32 need not necessarily be a through bore, but may be a blind bore at one or both ends of the second knuckles. This is because the second bore need only provide a sufficiently deep recess at the annular rim to receive the received portion 28*a*' of the balls 28. Since the balls 28 are snugly fitted with respect to the first bore 26 and abut the annular rim 232, there is very little play between the first and second knuckles 22, 24 and the hinge is pivotally operable with excellent retention of alignment of the first and second knuckles.

Figure 2:
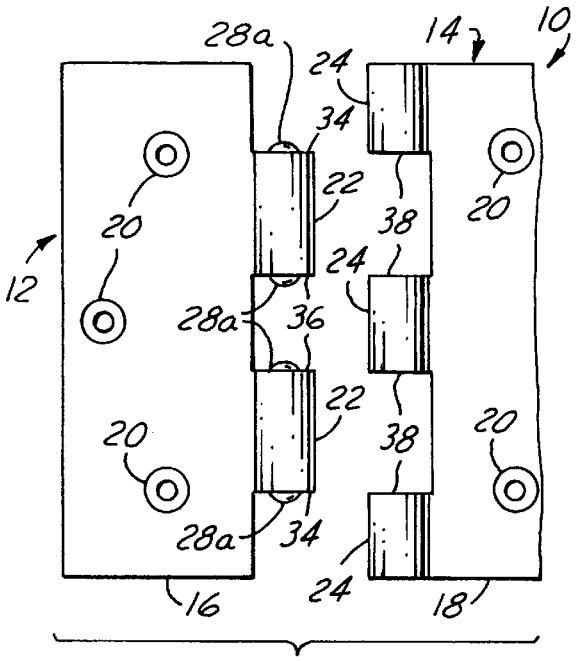
FIG. 2 is a partly broken-away plan view of the separable hinge according to the present invention, shown in a separated state.
Figure 10A:
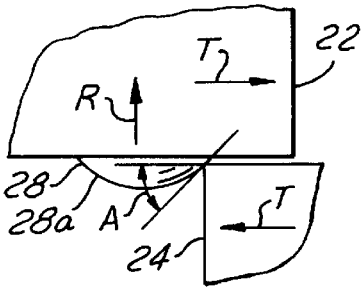
FIG. 10A is a partly sectional side view showing the first and second hinge components being assembled by application of an appropriately directed transverse force.

As shown at FIG. 10A, the amount of the protruding portion 28*a* of the balls 28 is predetermined so that the first and second knuckles 22, 24 are able to be slid in relation to each other into mutual alignment, ie., from the position shown at FIG. 2 to that shown at FIG. 1. The amount of protrusion of the protruding portion 28*a* is preselected in order that the spherical surface of the balls inclinably interacts with the second knuckle. For example, if the bails 28 protrude almost hemispherically from the first bore 26, then the angle of incline would be so close to ninety degrees that for practical purposes the balls could not be caused to retract into the first knuckle by a transverse force acting on the first and second hinge components 12, 14, no matter how light the spring force acting on them might be. On the other hand, if there is very little protrusion, then the angle of incline A a would be acute enough that just a small transverse force T can cause the balls 28 to retract (along arrow R) and assembly of the first and second hinge components 12, 14 is possible even in the face of a relatively large spring force acting on the balls.

Figure 10B:
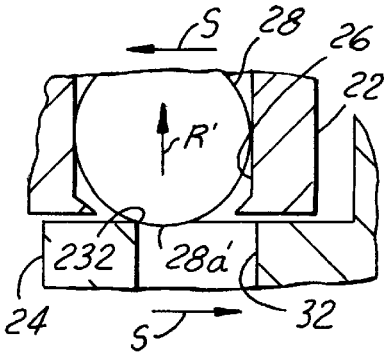
FIG. 10B is a partly sectional side view showing the first and second hinge components being separated by application of an appropriately directed shear force.

Similarly as shown at FIG. 10B, the amount of received portion 28*a* of the balls 28 is predetermined so that the first and second knuckles 24, 26 are able to be slid in relation to each other out of mutual alignment, ie., from the position shown at FIG. 1 to that shown at FIG. 2. The amount of the received portion 28*a* which enters the second bore 32 at the annular rim 232 is preselected in order that the spherical surface of the balls 28 inclinably interacts with the second knuckle 24. For example, if the balls 28 are received almost hemispherically into the second bore 32, then the angle of incline would be so close to ninety degrees that for practical purposes the balls could not be caused to retract into the first knuckle by a shear force acting on the first and second hinge components 12, 14, no matter how light the spring force acting on them might be. On the other hand, if there is relatively little of the balls 28 that is received into the second bores 32, then the angle of incline would be acute enough that just a small shear force S can cause the balls 28 to retract (along arrow R'), whereupon the first and second hinge components 12, 14 will separate from each other even in the face of a relatively large spring force acting on the balls.

A preferred method of providing the first knuckle 24 with the sub-assembly 35 is shown at FIGS. 5 through 9.

Figure 6:
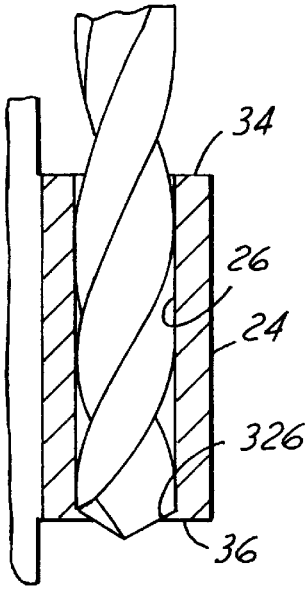
Figure 7:
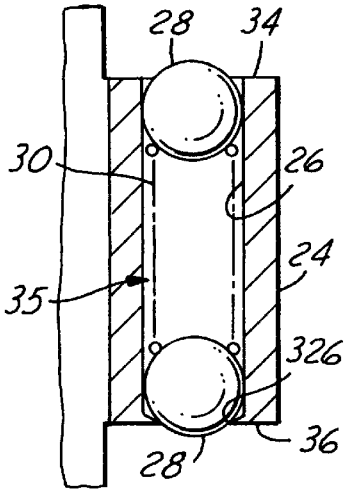
FIG. 7 is a partly sectional side view of the first bore now provided with a sub-assembly composed of a pair of spring-loaded balls.
Figure 8:
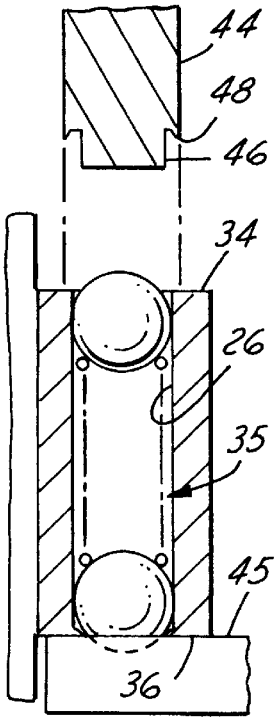
FIGS. 8 and 9 are partly sectional side views depicting a swedging process in which the first end of the first knuckle is provided with a reduced diameter which traps the sub-assembly within the first bore.
Figure 9:
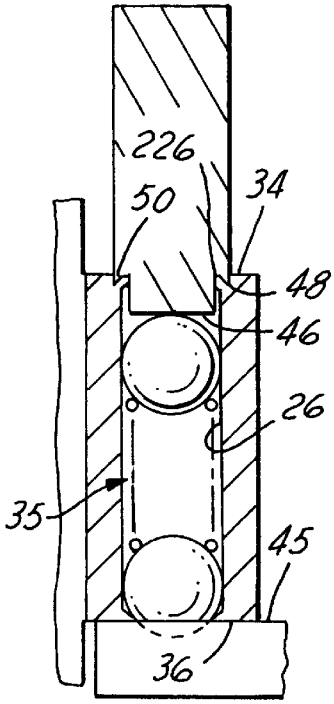

A bit 40 having a conical tip 42 provides the first bore 26 by drilling into the first knuckle from the first end 34 thereof to the second end 36 thereof, wherein the conical tip is stopped just short of full emergence at the second end so as to provide the second annular boss 326 adjacent the second end (see FIG. 6). Next, as shown at FIG. 7, the sub-assembly 35 is installed into the first bore, wherein the second annular boss 326 retains the adjoining ball 28 from fully exiting the first bore 26. Finally as shown at FIGS. 8 and 9, a swedging tool 44 is used to provide the first annular boss 226 adjacent the first end 34 in concert with a base 45 upon which is rested the second end 36 of the first knuckle.

The swedging tool 44 has a mandrel 46 and spaced upwardly therefrom is an annular die 48. A shown at FIG. 9, when the swedging tool 44 is engaged into the first end 34, the mandrel 46 enters the first bore 26 and the annular die 48 stampingly deforms the first end so that it is impressed with an annular slot 50 and thereby forces material to inwardly collapse upon the mandrel, which material forms the first annular boss 226. Upon withdrawal of the swedging tool 44 from the first bore 26, the first annular boss 226 interferingly prevents the adjoining ball 28 from fully exiting the first bore at the first end 34.

In operation of the separable hinge 10, upon assembly of the first knuckles 22, as outlined immediately above, and upon the second knuckles 24 being drilled to provide the second bore 32, the first and second knuckles are then interleaved by being forced together by a transverse force. The transverse force causes the balls 28 to retract against the force of the respective biasing springs 30 and the first and second knuckles slide into mutual alignment, whereupon an exactly predetermined received portion 28*a*' of the balls enter into respective second bores of the second knuckles.

Now the assembled separable hinge is connected to two relatively pivotal articles via the leaves 16, 18. The separable hinge provides pivoting therebetween in a mechanically durable and sound manner without rattle or play. However, if a predetermined magnitude of shear force is applied to the separable hinge as between the first and second hinge components 12, 14, the balls will be forced to retract against their respective biasing spring into the first bore of the first knuckle, whereupon the first and second knuckles will separate. Since the ball and biasing spring sub-assembly does not fly apart when the first knuckle separates from the second knuckle, it is a simple matter to reassemble the separable hinge 10 thereafter.

To those skilled in the art to which this invention appertains, the above described preferred embodiment may be subject to change or modification. For example, other biasing mechanisms can be used other than a spring to cause the balls to be biased radially away from each other, for example a sealed compressible fluid under pressure. Such change or modification can be carried out without departing from the scope of the invention, which is intended to be limited only by the scope of the appended claims.

What is claimed is:

1. A separable hinge comprising:

a first hinge component having at least one first knuckle, said at least one first knuckle having a first end and an opposite second end, said first knuckle having a first bore formed therein between said first end and said second end;

a second hinge component having at least two second knuckles, said at least two second knuckles each having at least one second bore formed therein for providing at least one recess respectively, wherein said first and second knuckles are configured to be interleavable with respect to each other whereat said first bore and said second bores are mutually aligned; and a sub-assembly located within said first bore comprising:

a first ball;

a second ball;

means for biasing said first and second balls radially away from each other;

first means connected with said first knuckle adjacent said first end and extending inwardly toward a center of said first bore for retaining a portion of said first ball in said first bore; and second means connected with said first knuckle adjacent said second end for retaining a portion of said second ball in said first bore;

wherein when said first and second knuckles are interleaved, said first and second balls are partly received in respective second bores of said at least two second knuckles.

2. The separable hinge of claim 1, wherein said at least one first knuckle comprises two first knuckles; and wherein said at least two second knuckles comprises three second knuckles, a respective said second knuckle being located at each of said first and second ends of each of said two first knuckles.

3. The separable hinge of claim 1, further comprising:

first leaf means connected with said first knuckle for connecting said first knuckle to a first article; and second leaf means connected with said second knuckle for connecting said second knuckle to a second article.

4. The separable hinge of claim 1, wherein said second bores provides at least one annular rim for respectively abutting each ball of said first and second balls; further wherein said first and second means comprise:

a first annular boss adjacent said first end; and a second annular boss adjacent said second end.

5. The separable hinge of claim 4, wherein said first and second annular bosses are integrally formed of said first knuckle.

6. The separable hinge of claim 5, wherein said first and second means respectively abut said first and second balls such that when said first and second knuckles are interleaved, said first and second balls contact the annular rim of respective said second knuckles without contacting said first and second abutment means.

7. The separable hinge of claim 6, wherein said first and second balls have a first predetermined diameter; further wherein said first bore has a second predetermined diameter slightly larger than said first predetermined diameter such that said first and second balls are snugly slidable in said first bore.

8. The separable hinge of claim 7, wherein said at least one first knuckle comprises two first knuckles; and wherein said at least two second knuckles comprises three second knuckles, a respective said second knuckle being located at each of said first and second ends of each of said two first knuckles.

9. The separable hinge of claim 7, further comprising:

first leaf means connected with said first knuckle for connecting said first knuckle to a first article; and second leaf means connected with said second knuckle for connecting said second knuckle to a second article.

10. A separable hinge comprising:

a first hinge component having at least one first knuckle, said at least one first knuckle having a first end and an opposite second end, said first knuckle having a first bore formed therein between said first end and said second end;

a second hinge component having at least two second knuckles, said at least two second knuckles each having at least one second bore formed therein for providing at least one recess respectively, each recess having an annular rim, wherein said first and second knuckles are configured to be interleavable with respect to each other whereat said first bore and the annular rim of each recess of said at least one second bore are mutually aligned; and a sub-assembly located within said first bore comprising: a first ball;

a second ball; and means for biasing said first and second balls radially away from each other;

first means connected with said first knuckle adjacent said first end and extending inwardly toward a center of said first bore for retaining a portion of said first ball in said first bore; and second means connected with said first knuckle adjacent said second end for retaining a portion of said second ball in said first bore;

wherein when said first and second knuckles are interleaved, said first and second balls are partly received in a respective second bore of said at least two second knuckles; and wherein said first and second means respectively abut said first and second balls such that when said first and second knuckles are interleaved, said first and second balls contact the annular rim of respective said second knuckles without contacting said first and second means.

11. The separable hinge of claim 10, further comprising:

first leaf means connected with said first knuckle for connecting said first knuckle to a first article; and second leaf means connected with said second knuckle for connecting said second knuckle to a second article.

12. The separable hinge of claim 10, wherein said first and second balls have a first predetermined diameter; further wherein said first bore has a second predetermined diameter slightly larger than said first predetermined diameter such that said first and second balls are snugly slidable in said first bore.

13. The separable hinge of claim 12, wherein said at least one first knuckle comprises two first knuckles; and wherein said at least two second knuckles comprises three second knuckles, a respective said second knuckle being located at each of said first and second ends of each of said two first knuckles.

14. The separable hinge of claim 13, further comprising:

first leaf means connected with said first knuckle for connecting said first knuckle to a first article; and second leaf means connected with said second knuckle for connecting said second knuckle to a second article.

* * * * *